US010377618B1

(12) United States Patent
Wielebski

(10) Patent No.: US 10,377,618 B1
(45) Date of Patent: Aug. 13, 2019

(54) SYSTEMS AND METHODS RELATED TO BEVERAGE PACKAGING

(71) Applicant: Timothy J. Wielebski, Dousman, WI (US)

(72) Inventor: Timothy J. Wielebski, Dousman, WI (US)

( * ) Notice: Subject to any disclaimer, the term of this patent is extended or adjusted under 35 U.S.C. 154(b) by 359 days.

(21) Appl. No.: 15/402,683

(22) Filed: Jan. 10, 2017

Related U.S. Application Data

(60) Provisional application No. 62/305,002, filed on Mar. 8, 2016.

(51) Int. Cl.

| | |
|---|---|
| ***B67B 7/16*** | (2006.01) |
| ***B65D 71/58*** | (2006.01) |
| ***B65D 5/468*** | (2006.01) |
| ***B65D 5/42*** | (2006.01) |
| ***B65D 1/02*** | (2006.01) |
| ***B65D 41/12*** | (2006.01) |

(52) U.S. Cl.
CPC ..... *B67B 7/16* (2013.01); *B65D 1/02* (2013.01); *B65D 5/4266* (2013.01); *B65D 5/4608* (2013.01); *B65D 41/12* (2013.01); *B65D 71/0022* (2013.01); *B65D 2571/00388* (2013.01); *B65D 2571/00487* (2013.01); *B65D 2571/00981* (2013.01)

(58) Field of Classification Search
CPC ..... B65D 1/02; B65D 5/42; B65D 5/4266; B65D 5/46; B65D 5/4608; B65D 41/12; B65D 71/00; B65D 71/0022; B65D 2571/00388; B65D 2571/00487; B65D 2571/00981; B67B 7/16; B67B 7/44
USPC ..... 206/139–149, 162–200; 81/3.08, 3.09, 81/3.15
See application file for complete search history.

(56) References Cited

U.S. PATENT DOCUMENTS

| | | | | |
|---|---|---|---|---|
| 1,060,674 A | | 5/1913 | Foster | |
| 2,806,393 A | * | 9/1957 | Vickers | B65D 71/0003 81/3.09 |
| 2,821,101 A | * | 1/1958 | Hendricks | B67B 7/16 81/3.09 |
| 2,875,654 A | * | 3/1959 | Straub | B67B 7/16 81/3.15 |
| 2,990,972 A | | 7/1961 | Benedetti | |
| 3,055,541 A | | 9/1962 | Bonkowski | |
| 3,120,140 A | | 2/1964 | Wiles | |
| 4,335,814 A | | 6/1982 | Benning et al. | |
| 4,979,407 A | * | 12/1990 | Hernandez | B67B 7/44 81/3.09 |
| 6,295,894 B1 | | 10/2001 | Craig | |
| 7,987,976 B2 | * | 8/2011 | Stowers | B67B 7/16 206/139 |
| 9,359,180 B1 | * | 6/2016 | Visconti | B67B 7/16 |
| 9,695,026 B2 | * | 7/2017 | Simmons | B67B 7/16 |
| 9,945,552 B2 | * | 4/2018 | Johnson | B67B 7/16 |

* cited by examiner

*Primary Examiner* — Bryon P Gehman
(74) *Attorney, Agent, or Firm* — Donald J. Ersler

(57) ABSTRACT

Systems and methods directed to the art of secondary beverage packaging include a device or structure for assisting in the opening of primary beverage packaging which may, prior to opening, have been at least partially contained in the secondary beverage packaging.

12 Claims, 7 Drawing Sheets

SYSTEMS AND METHODS RELATED TO BEVERAGE PACKAGING

CROSS-REFERENCES TO RELATED APPLICATIONS

This is a utility patent application taking priority from provisional application No. 62/305,002 filed on Mar. 8, 2016.

BACKGROUND OF THE INVENTION

Field of the Invention

The present invention relates to beverage packaging, and more particular to secondary beverage packaging incorporating a device to assist in opening primary beverage packaging.

Discussion of the Prior Art

Prior tools for opening primary beverage packaging, such as a glass bottle having a crimp-on crown cap, include many variations, which may include bottle openers having a substantial leverage handle many times the length of any structure adapted to engage the cap. U.S. Pat. No. 1,060,674 to foster discloses a bottle opener. U.S. Pat. No. 2,990,972 to Benedetti discloses a bottle opener and carton combination. U.S. Pat. No. 3,055,541 to Bonkowski discloses a combined beverage carrier and cap remover. U.S. Pat. No. 3,120,140 to Wiles discloses an available lifter for a disposable bottle crown cap. U.S. Pat. No. 4,335,814 to Benning et al. discloses a bottle carton with integral opener. U.S. Pat. No. 6,295,894 to Craig discloses a beverage package with incorporated bottle cap opener.

Accordingly, the art of secondary beverage packaging may be improved by providing a device to assist in opening primary beverage packaging, where such device is incorporated into or otherwise coupled to the secondary beverage package (e.g., sales package).

SUMMARY OF THE INVENTION

Systems and methods according to the present invention provide improved packaging incorporating a container opener, such as a bottle opener.

One aspect of an opener according to the present invention may be that an opener plate may be substantially flat and streamlined into or flush mounted to the packaging with no extremities reaching beyond the original footprint of the packaging which may catch or snag clothing garments or fingers while carrying the packaging. Further, if so provided, this substantially flat, integrated feature preferably does not interfere with primary beverage packaging (e.g. bottle) insertion process into secondary packaging. Also, it preferably does not interfere with shipping processes with regard to palletization or modular stacking.

Another aspect of an opener according to the present invention is that an opener plate may be conveniently removable from secondary beverage packaging, such as by providing perforations of that packaging circumscribing an opener plate. In this fashion, the opener plate may be separated (along with some of the secondary packaging) from the remainder of the packaging. The opener may thus be used while coupled to the packaging or after being removed therefrom. When in detached use, the opener plate may remain substantially shrouded in secondary (e.g., cardboard) packaging adding a layer of "padding" for applying leverage to open a bottle cap.

According to an alternative embodiment of secondary packaging according to the present invention, an opening device may be adhered to an exterior surface of a packaging panel.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
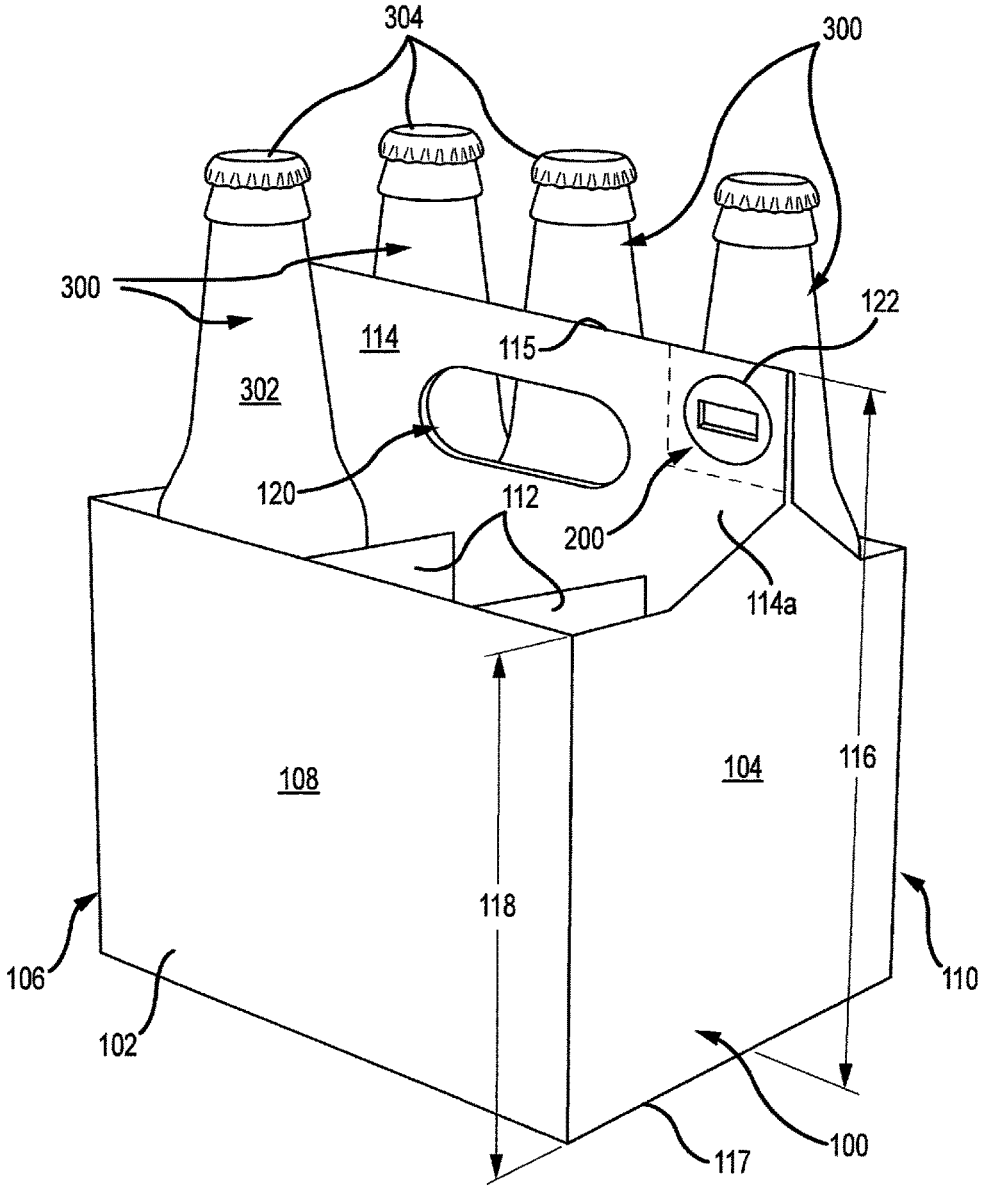
FIG. 1 is a perspective view of primary beverage packaging positioned at least partially within a first embodiment of secondary beverage packaging according to the present invention.

Turning now to the figures, FIG. 1 depicts a first embodiment 100 of secondary packaging (e.g. secondary beverage packaging) at least partially containing primary packaging 300 (e.g., beverage containers in direct contact with the packaged beverage). This embodiment 100 is preferably configured to hold a plurality of primary beverage packages 300 (e.g., glass bottles 302 with crimped crown bottle caps 304), most preferably four to six primary beverage packages 300. The secondary packaging 100 is substantially of conventional structure, often of a paperboard or cardstock material that has been die punched or otherwise cut into a desired shape, folded, and adhered to itself to form the desired shape. While overall dimensions may fluctuate, the secondary packaging usually comprises a box 102 extending between and including at least substantially parallel first and second ends 104,106 and first and second lateral sides 108,110. Disposed within the box 102 may be one or more lateral dividers 112 and one or more longitudinal dividers 114 running at least substantially perpendicular to the lateral dividers 112. One of the longitudinal dividers 114*a* is preferably at least substantially medially located between the lateral sides 108,110, and may extend along a height 116 that is greater than a height 118 of the sides 108,110. The medial lateral divider 114*a* preferably includes an opening 120 formed therethrough, the opening being substantially medially located along a length 122 defined by the two ends 104,106.

The description of the secondary packaging 100 in the previous paragraph parallels known secondary packaging construction. According to the present invention, however, included in or on the secondary packaging 100 is a device or structure 200 for assisting in the opening of one of the primary beverage packages 300. The opening device 200 is generally configured to receive a portion of the primary beverage package and to assist a user in removing the engaged portion from the primary beverage package. For example, the device 200 may be configured to receive a portion of a crown bottle cap 304 that had been previously crimped onto a glass bottle 302 to assist a user in removing the cap 304 from the bottle 302.

The opening device 200 preferably includes a plate 202 including a structure 204 configured to receive at least a portion of a crown bottle cap 304. The structure 204 may be in the form of a throughopening 206 extending completely through the plate 202, as shown. Though shown exposed, the structure 204 may be substantially covered by removable portions, such as flaps (not shown), of the box 102, so as to provide additional advertising space on the package 100. The structure 204 provides a fulcrum edge 208 and a leverage edge 210, the leverage edge 210 and fulcrum edge 208 disposed on opposite sides of the structure 204. The fulcrum edge 208 and leverage edge 210 are spaced from each other preferably about 10 millimeters to about 18 millimeters, with about 13 millimeters being most preferred. In operation, one of the fulcrum edge 208 and the leverage edge 210 engages a top surface 304*a* of a bottle cap 304 and the other of the fulcrum edge 208 and the leverage edge 210 engages a bottom surface 304*b* of the same bottle cap 304. In addition to providing a structure 204 to assist in opening a primary beverage container, the device 200 may be printed with a code 212, such as a serial number or contest (e.g. sweepstakes) code.

The printing of the code 212 may be performed by ink, such as by screen printing, or additionally or alternatively by stamping, etching, engraving, etc. In some situations, it may be desirable to separate the opening device 200 from the remainder of the secondary packaging 100. To ease in such separation, perforations 214 may be provided (e.g. in the longitudinal divider 114*a*) circumscribing the plate 202, such that a portion of the type of material forming at least a majority of the box 102 may be more easily torn and the device 200 separated from the remainder of the package 100.

The device 200 may have a preferred orientation on the packaging 100, though any location on the package 100 is contemplated as long as the combination of the material of the device 200 and the material of the box 102 provides sufficient rigidity and strength to perform the desired function. First, the entirety of the device 200 may be located on the same panel of the box 102 (e.g., the longitudinal divider 114*a*, as shown) as the aperture 120 providing a handle. Thus, there may be conveniently provided on the same panel both a handle for carrying the container 100 in addition to an opener 200. This may be advantageous for manufacturing purposes because the handle aperture 120 is being punched anyway, so such positioning may alleviate additional punches added to a die to punch portions of panels that do not otherwise include apertures. That is, there may be more machine real estate to add a punch that may be used as further described below. In the instance of a 4-pack, or 6-pack container as shown, the device 200 may be disposed on the longitudinal divider 114*a*, as that divider 114*a* may be formed from a plurality of layers of box material, thereby providing either or both of a convenient location to mount the device 200 and additional structural strength above and beyond that which may be provided by a single layer of box material. Alternatively, the device 200 may be adhered or otherwise fastened to another surface of the box 102, and may be configured to be removed and used separate and apart from the box 102.

Figures 2A, 2B:
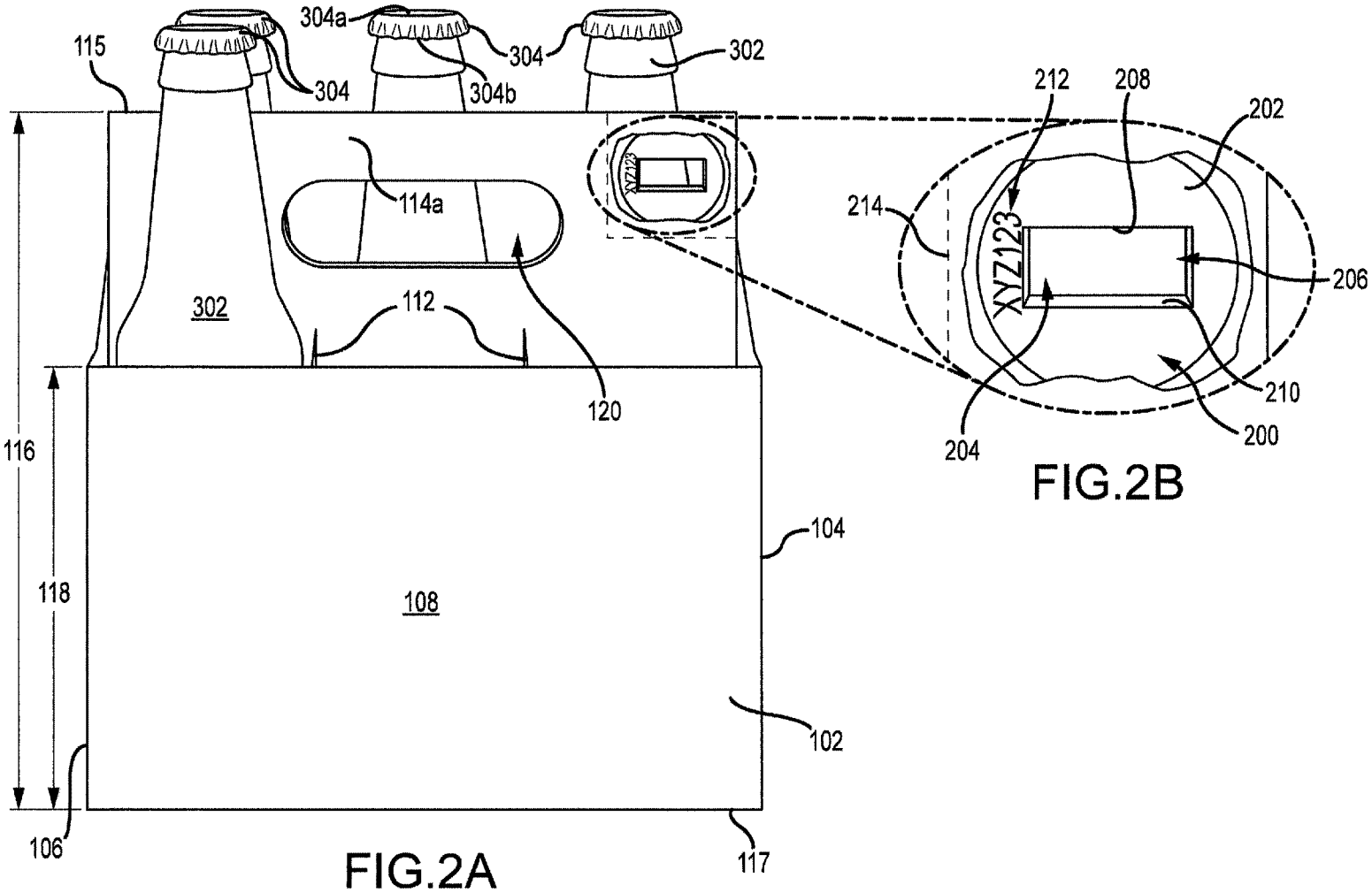
FIG. 2A is a front elevation, partial cutaway view of the packaging of FIG. 1.
FIG. 2B is a close-up view of the partial cutaway portion of FIG. 2A.

Additionally or alternatively, with respect to positioning, the device 200 may preferably be substantially radially aligned with one or more of the primary beverage packages 300, as shown. That is, functionally speaking, it is preferable to have the device 200 positioned to minimize the number of primary containers 300 that need to be removed from the box 102 to conveniently use the opening device 200. By "conveniently use" is meant that opening a primary beverage container 300 can be accomplished without contacting any other beverage containers 300 that remain in a previously fully populated box 102 after only a single beverage container 300 (located closer to the opening device 200 than most others) has been removed therefrom. Thus, as depicted, it can be seen that the opening device 200 may be conveniently used by removing either the front or rear rightmost bottle 302 in FIG. 2A. Although contemplated by embodiments according to the present invention, positioning of the opening device 200 in line with a lateral divider 112, for instance, may impede convenient use.

Figure 4A:
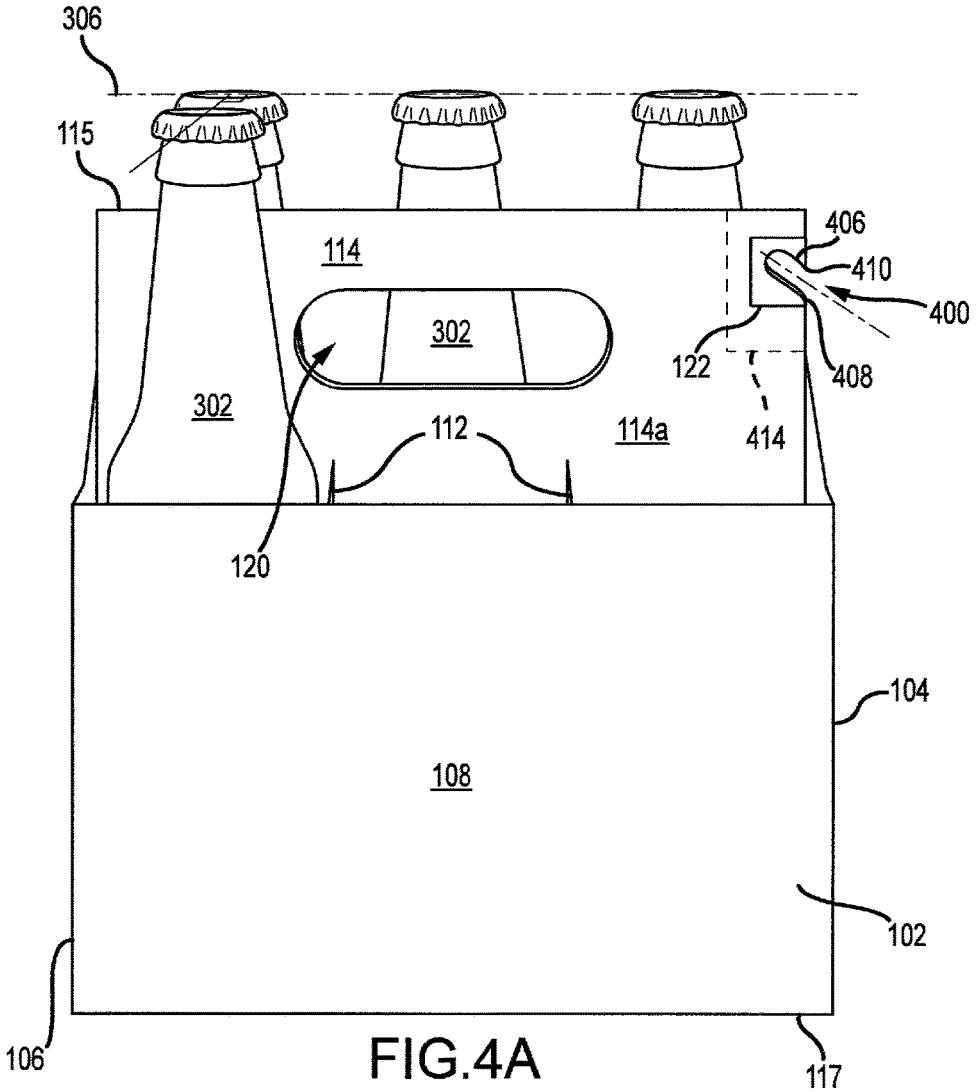
FIG. 4A is a front elevation view of primary beverage packaging positioned at least partially within a second embodiment of secondary beverage packaging according to the present invention.

Additionally or alternatively, with respect to positioning, the device 200 may preferably be positioned such that the fulcrum edge 208 and/or the leverage edge 210 are oriented at least substantially parallel to a plane that is defined by the top surface 304*a* of one or a plurality of the bottle caps 304, as shown (e.g. a line 306 in FIG. 4A lies in, and represents, such plane). The fulcrum edge 208 and/or the leverage edge 210 may alternatively be oriented at an angle with respect to that plane. For instance, if the device 200 is placed on the longitudinal divider 114*a*, and closer to the first end 104 than the second end 106, (as shown) the fulcrum edge 208 and/or leverage edge 210 may slope upwards towards a top edge 115 of the divider 114*a* closer to the first end 104.

If the device 200 is placed on the longitudinal divider 114*a*, and closer to the second end 106 than the first end 104, (not shown) the fulcrum edge 208 and/or leverage edge 210 may slope upwards towards a top edge 115 of the divider 114*a* closer to the second end 106. This angular presentation of the fulcrum edge 208 and/or leverage edge 210 may be advantageous to provide a greater range of utility of the device 200 so as to substantially remove the lateral box sides 108,110 from interfering with use of the device 200. That is, rather than inserting a bottle 300 (or cap 304) into the device 200 in radial alignment with another bottle 300 the device 200 may be approached from and over the first end 104 or second end 106.

Figure 3A:
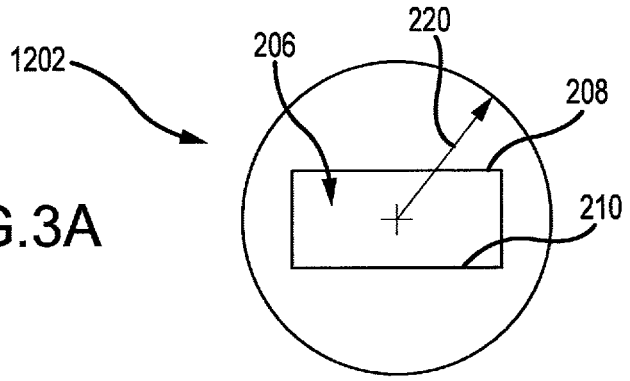
FIG. 3A is a front elevation view of a first embodiment of a packaging insert according to the present invention.

FIGS. 3A-3D depict alternate embodiments of a plate 202 according to the present invention. A first embodiment 1202 in FIG. 3A is the same as the plate 202 described previously. Generally, this embodiment 1202 is a substantially circular disk having a preferred radius 220 of about 15 millimeters to about 25 millimeters and a thickness of about 1 millimeter to about 1.6 millimeters (20 gauge to 16 gauge steel equivalent). At least substantially centered on and extending through the plate 1202 is a substantially rectangular slot or throughopening 206 to provide the fulcrum edge 208 and leverage edge 210, which may extend at least substantially parallel to each other.

Figure 3B:
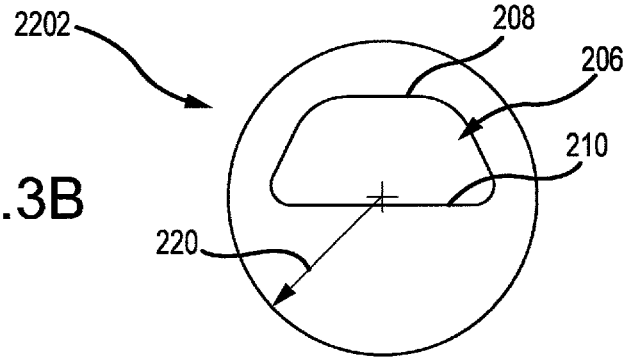
FIG. 3B is a front elevation view of a second embodiment of a packaging insert according to the present invention.

FIG. 3B shows a second embodiment 2202 of a plate according to the present invention. This embodiment 2202 is substantially the same as the previous embodiment described herein, with two primary exceptions. First, the throughopening 206 is generally trapezoidal in shape, provided with a shorter fulcrum edge 208 and a longer leverage edge 210, respectively. Second, the throughopening 206 is not substantially centered on the disk, but is rather radially disposed such that the shorter fulcrum edge 208 is radially closer to the disk perimeter than the longer leverage edge 210. In this embodiment, in other words, a majority of the throughopening 206 is situated on half of the plate 2202.

Figure 3C:
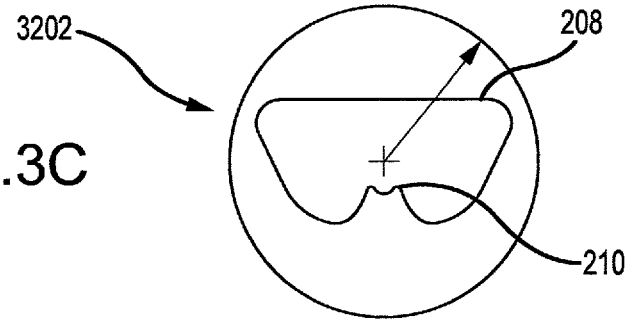
FIG. 3C is a front elevation view of a third embodiment of a packaging insert according to the present invention.

FIG. 3C shows a third embodiment 3202 of a plate according to the present invention. This embodiment 3202 is substantially the same as the first embodiment 1202 described herein, with two primary exceptions. First, the throughopening 206 is generally trapezoidal in shape, provided with a longer fulcrum edge 208 and a shorter leverage edge 210, respectively. Second, the shorter leverage edge 210 is formed as a medial tooth.

Figure 3D:
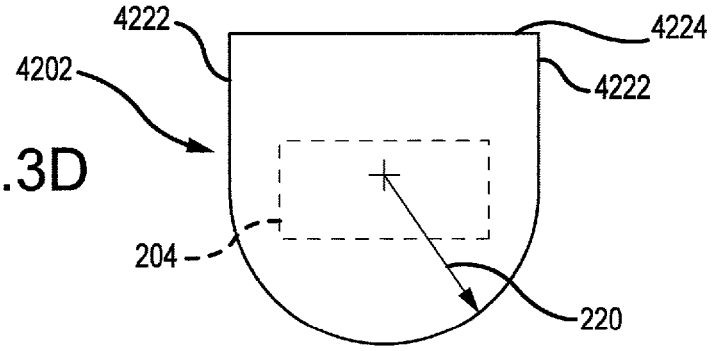
FIG. 3D is a front elevation view of a fourth embodiment of a packaging insert according to the present invention.

FIG. 3D shows a fourth embodiment 4202 of a plate according to the present invention. Like the other embodiments described herein, this plate 4202 includes an opening structure 204, but the plate 4202 is not formed as a substantially round disk. Rather, this plate 4202 extends along longitudinal sides 4222 and terminates at a preferably linear top edge 4224. A linear top edge 4224 may be advantageously employed to assist in registration of the plate 4202 with respect to a box (e.g. 102) during assembly, as described below.

It is to be understood that any of the above features may be combined, and the elaboration of each plate embodiment is not restrictive. For instance, the rectangular shaped through opening 206 of the first embodiment 1202 may be positioned so that a majority of the throughopening 206 is situated on half of the plate 1202, like that of the second embodiment 2202.

Alternatively, a trapezoidal shaped throughopening 206 of the second embodiment 2202 may be substantially centered on the plate 2202, like that of the first embodiment 1202. Further, the opening structure 204 of the fourth embodiment 4202 may be situated between the longitudinal sides 4222 closer to the top edge 4224.

A plate 202 according to the present invention may be formed using any suitable method operable on a desired material. For instance, the plate 202 may be formed of a metal (e.g., steel (including, specifically, steel alloys or electrogalvanized cold rolled steel) and/or aluminum (including alloys)) or a plastic (e.g., copolyester, polypropylene (PP), high density polyethylene (HDPE), polyethylene terephthalate (PET)). Sheets of such materials may be punched or machined in a pattern so as to produce the desired shape of the plate 202 and corresponding opening structure 204. Plates 202 may also be cast or molded (e.g., injection molded).

Figure 4B:
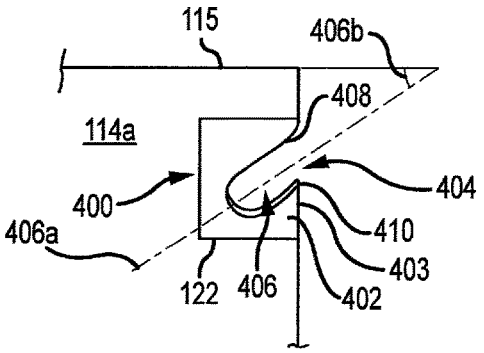
FIG. 4B is a close-up view of FIG. 4A.

FIGS. 4A and 4B depicts an alternate embodiment of a primary package opening device 400 disposed on or in secondary packaging 102 according to the present invention, where similar reference numerals (4xx) refer to structure that is functionally equivalent to structure (2xx) of the first embodiment. This opening device 400 preferably includes a plate 402 including a structure 404 configured to receive at least a portion of a crown bottle cap 304. The structure 404 may be in the form of a slot 406 extending completely through the plate 402 and through an outwardly disposed edge 403, as shown. The structure 404 provides a fulcrum edge 408 and a leverage edge 410, the leverage edge 410 and fulcrum edge 408 disposed on opposite sides of the structure 404. The fulcrum edge 408 and leverage edge 410 are spaced from each other preferably about 10 millimeters to about 18 millimeters, with about 13 millimeters being most preferred. In operation, one of the fulcrum edge 408 and the leverage edge 410 engages a top surface 304*a* of a bottle cap 304 and the other of the fulcrum edge 408 and the leverage edge 410 engages a bottom surface 304*b* of the same bottle cap 304. The slot 406 extends along, or generally in the direction of, a longitudinal slot axis 406*a*, which is disposed a predetermined angle 406*b* with respect to a horizontal reference (e.g., a linear top edge 115 of the divider 114*a*, a plane 306 defined by a plurality of cap top surfaces 304*a*, or horizontal support surface, such as a table). It may be undesirable to have too great of an angle 406*b*. If too great (as 406*b* approaches vertical), there is a limit as to the usability of the device 400. That is, spillage may occur. Accordingly, it has been found workable to maintain the angle 406*b* at about zero to about 25 degrees with about zero to about fifteen degrees being more preferred.

In addition to providing a structure 404 to assist in opening a primary beverage container, the device 400 may be printed with a code (not shown), such as a serial number or contest (e.g. sweepstakes) code. The printing of the code may be performed by ink, such as by screen printing, or additionally or alternatively by stamping, etching, engraving, etc. In some situations, it may be desirable to separate the opening device 400 from the remainder of the secondary packaging. To ease in such separation, perforations 414 may be provided (e.g. in the longitudinal divider 114*a*) circumscribing the plate 402, such that a portion of the type of material forming at least a majority of the box 102 may be more easily torn and the device 400 separated from the remainder of the package.

The device 400 may have a preferred orientation, though any location on the box 102 is contemplated as long as the combination of the material of the device 400 and the material of the box 102 provides sufficient rigidity and strength to perform the desired function. First, the entirety of the device 400 may be located on the same panel of the box 102 (e.g., the longitudinal divider 114*a*, as shown) as the aperture 120 providing a handle. Thus, there may be conveniently provided on the same panel both a handle for carrying the container 100 in addition to an opener 400. This may be advantageous for manufacturing purposes because the handle aperture 120 is being punched anyway, so such positioning may alleviate additional punches added to a die to punch portions of panels that do not otherwise include apertures. That is, there may be more machine real estate to add a punch that may be used as further described below. In the instance of a 4-pack, or 6-pack container as shown, the device 400 may be disposed on the longitudinal divider 114*a*, as that divider 114*a* may be formed from a plurality of layers of box material, thereby providing either or both of a convenient location to mount the device 400 and additional structural strength above and beyond that which may be provided by a single layer of box material. Alternatively, the device 400 may be adhered or otherwise fastened to another surface of the box 102, and may be configured to be removed and used separate and apart from the box 102.

Figure 5A:
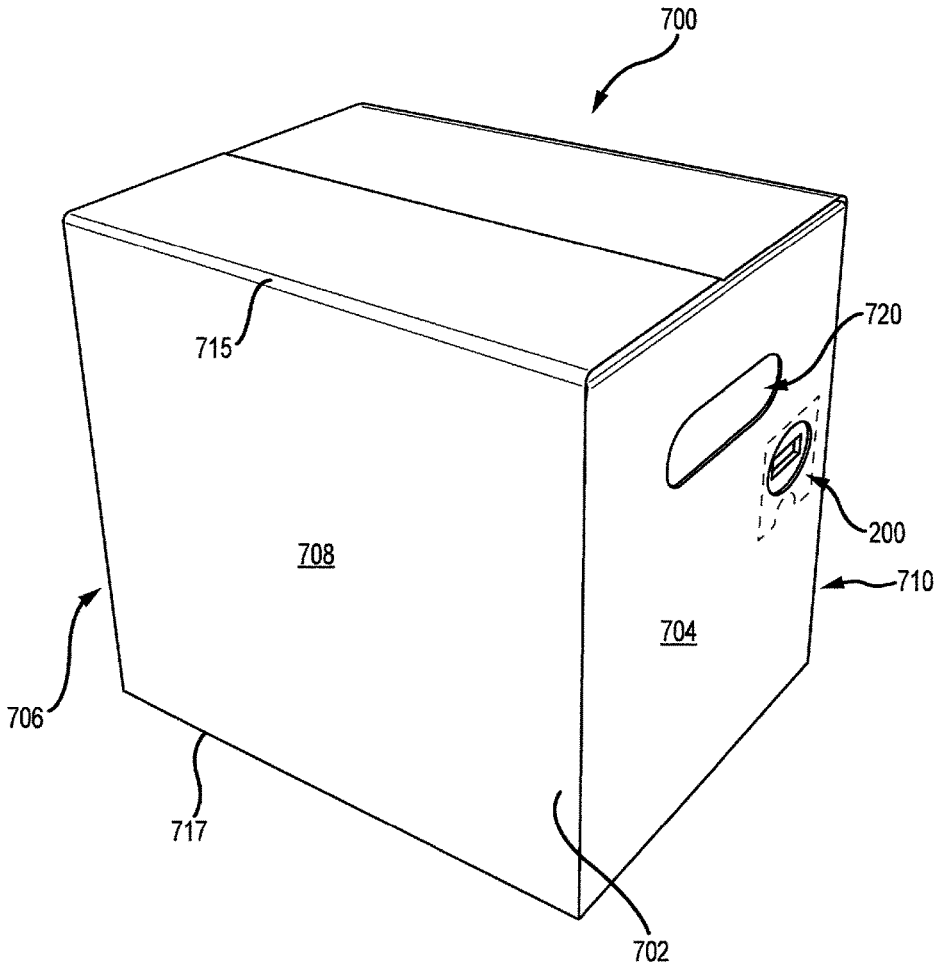
FIG. 5A is a perspective view of a third embodiment of secondary beverage packaging according to the present invention.
Figure 5B:
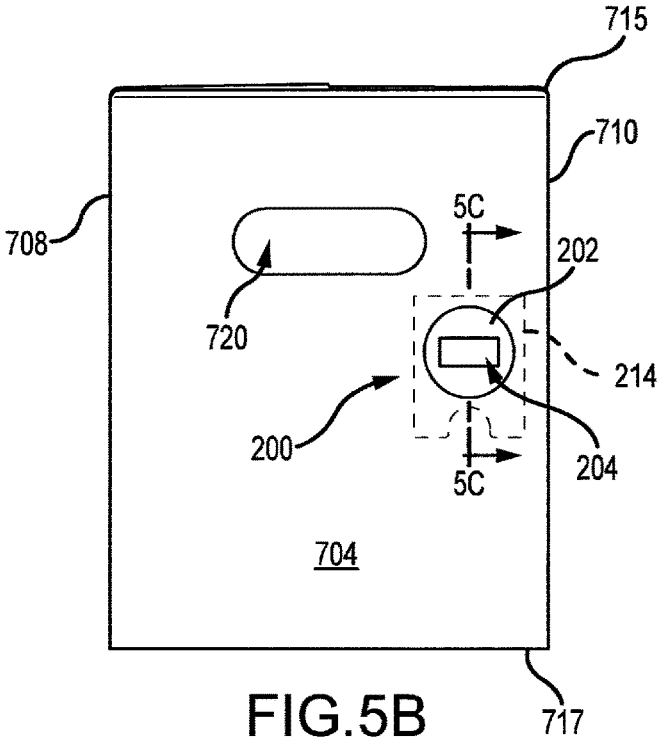
FIG. 5B is a right elevation view of the embodiment of FIG. 5A.
Figure 5C:
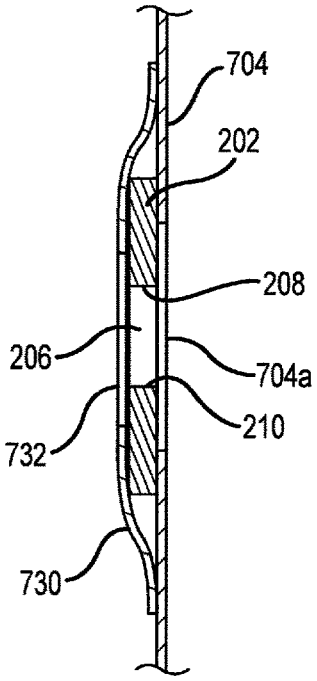
FIG. 5C is a cross-sectional view taken along lines 5C-5C of FIG. 5B.

Turning now to FIGS. 5A-5C, another alternative embodiment 700 of a secondary packaging according to the present invention is shown, where similar reference numerals (7xx) refer to structure that is functionally equivalent to structure (1xx) of the first embodiment 100. Generally, this embodiment 700 includes a substantially parallelepiped box 702, with an opening device 200 preferably positioned on an end (e.g. 704), where the same end (e.g. 704) includes a handle aperture 720. While the device 200 may be conveniently located elsewhere, an end including an aperture may be advantageous for production purposes, as indicated previously. In this embodiment, a plate 202 may be sandwiched between the box end 704 and a retaining patch 730. A throughhole of the structure 204 may be provided by an aperture 704*a* provided through the box 702, a through opening 206 provided through the plate 202, and an aperture 732 provided through the retaining patch 730. While the box 702 may be formed of a first material (e.g., corrugated cardboard), the retaining patch 730 may be formed of the same or a different material (e.g., paperboard). The retaining patch 730 is one way of assisting securement of the plate 202 to the box 702. Additionally or alternatively, the plate 202 may be simply adhered to the inside of the box 702, or the plate 202 may be sandwiched between constructive layers of the material of the box 702.

Secondary packaging according to the present invention may advantageously be formed by using existing packaging process, but further including the step of incorporating an opening device according to the present invention. Generally, secondary beverage packaging, such as boxes, including 4-pack, 6-pack, and 12-pack boxes are generally constructed by die punched a printed or blank cardboard stock. The general form factor of existing boxes may advantageously generally remain unchanged. The die punch or cutter forms any holes for handles, perforations, and any flaps that will assist in the formation of the shape of the box. Die cut blanks then proceed through a folder/gluer machine, such that tabs and panels are folded and glued to create the three dimensional form of the final secondary packaging or box. After folding and gluing, the packaging may remain generally flat until it is ready to have beverage bottles inserted into it. As heretofore described, the construction methodology has been previously known. To incorporate an opening device (e.g., 200) according to the present invention, slight modifications to existing container formation processes may be undertaken. In a die cutting or punching step, an access port XXX or perforations (e.g., 214) may be formed in the box (e.g., 102) at a predetermined location. In an application step, preferably after box blanks are die punched and prior to folding and/or gluing of box portions, a plate (e.g., 202) may be placed adjacent to the predetermined location in a desired orientation. The orientation may be aided by plate shape, such as registration of a portion of the plate against a folded portion of the box. An indexer may be provided to align plates (e.g., 202) with respect to the machine direction. Plates may be provided with pressure sensitive adhesive, or adhesive may be applied to each plate prior to engaging a box. Upon seating a plate onto a box blank, the blank would proceed through the remainder of the box forming process, such as folding and/or gluing. If a retaining patch (e.g. 730) is used, the patch may be previously adhered to a plate, thereby forming a patched plate combination. An indexer used in the process may thus present patched plates to a box process, such as a corrugated 12-pack process.

Figure 6B:
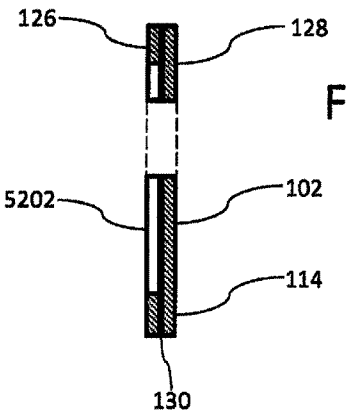
FIG. 6B is a cross-sectional view of an opening device contained in a cutout, which is formed in one layer of a longitudinal divider of a cardboard box.
Figure 6C:
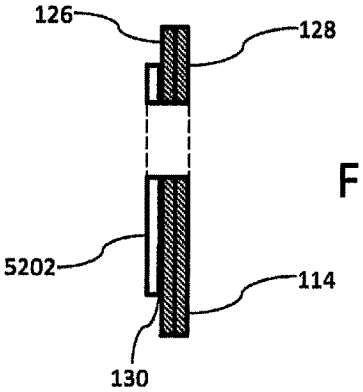
FIG. 6C is a side view of an opening device attached directly to an outside surface of a longitudinal divider of a cardboard box.
Figure 6A:
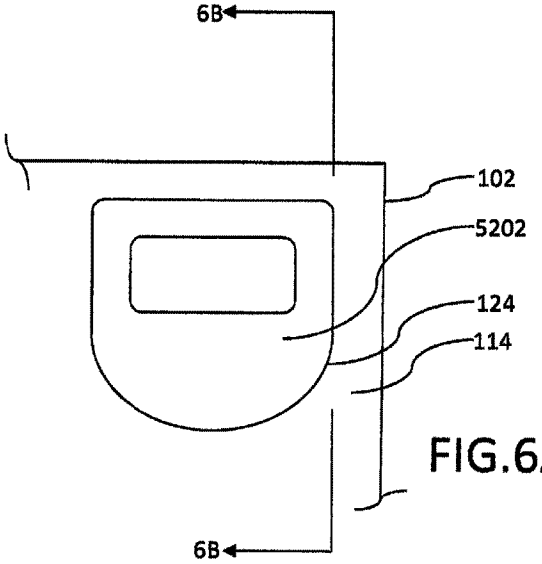
FIG. 6A is a front view of an opening device contained in a cutout, which is formed in one layer of a longitudinal divider of a cardboard box.

With reference to FIGS. 6A-6B, an opening device 5202 is contained in a cutout 124, which is formed in one cardboard layer 126 of a longitudinal divider 114 of a cardboard box 102. The opening device 5202 is attached to a second cardboard layer 128 of the cardboard box 102 with a glue, an adhesive, a cement or any other suitable adhering substance 130. With reference to FIG. 6C, the opening device 5202 is attached to an outside surface of the first cardboard layer 126 with a glue, an adhesive, a cement or any other suitable adhering substance 130.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A bottle opening device retained by a box, said box is capable of carrying a plurality of bottles, the plurality of bottles are sealed with a plurality of bottle caps, comprising:

said bottle opening device includes a plate, said plate includes one of an opening and a slot, said opening or said slot includes a fulcrum edge and a leverage edge, wherein a user may insert one edge of a bottle cap under said leverage edge and pulls the bottle cap against said fulcrum edge to remove the bottle cap from a sealed bottle; and said box includes a first lateral side, a second lateral side, a first end, a second end and a longitudinal divider, said first end terminates a first end of said first and second lateral sides, said second end terminates a second end of said first and second lateral sides, said longitudinal divider is located between said first and second lateral sides, said longitudinal divider includes a first layer and a second layer, a hand opening is formed through said longitudinal divider, said bottle opening device is retained between said first layer and said second layer, a length of said fulcrum edge and a length of said leverage edge are each parallel with said first and second layers, a clearance opening is formed through said first and second layers to provide access to said fulcrum edge and said leverage edge.

2. The bottle opening device retained by a box of claim 1 wherein:

said bottle opening device includes a substantially trapezoidal opening, said leverage edge and said fulcrum edge are formed on opposing sides of said trapezoidal opening.

3. The bottle opening device retained by a box of claim 1 wherein:

said bottle opening device includes a substantially trapezoidal opening, said leverage edge and said fulcrum edge are formed on opposing sides of said trapezoidal opening, said leverage edge includes a medial tooth.

4. The bottle opening device retained by a box of claim 1 wherein:

said bottle opening device includes a cap slot formed in one side thereof, said slot includes said leverage edge and said fulcrum edge, said leverage edge and said fulcrum edge are formed on opposing sides of said slot.

5. The bottle opening device retained by a box of claim 1 wherein:

perforations encompass said bottle opening device, said perforations are capable of allowing said bottle opening device to be removed from said first and second layers.

6. The bottle opening device retained by a box of claim 1 wherein:

an alpha-numeric code is affixed to said bottle opening device.

7. A bottle opening device retained by a box, said box is capable of carrying a plurality of bottles, the plurality of bottles are sealed with a plurality of bottle caps, comprising:

said bottle opening device includes a plate, said plate includes one of an opening and a slot, said opening or said slot includes a fulcrum edge and a leverage edge, wherein a user may insert one edge of a bottle cap under said leverage edge and pulls the bottle cap against said fulcrum edge to remove the bottle cap from a sealed bottle; and said box includes a first lateral side, a second lateral side, a first end, a second end and a longitudinal divider, said first end terminates a first end of said first and second lateral sides, said second end terminates a second end of said first and second lateral sides, said longitudinal divider is located between said first and second lateral sides, said longitudinal divider includes a first layer and a second layer, a hand opening is formed through said longitudinal divider, said bottle opening device is retained between said first layer and said second layer, a length of said fulcrum edge and said leverage edge are parallel with said first and second layers, a clearance opening is formed through said first and second layers to provide access to said fulcrum edge and said leverage edge.

8. The bottle opening device retained by a box of claim 7 wherein:

said bottle opening device includes a substantially trapezoidal opening, said leverage edge and said fulcrum edge are formed on opposing sides of said trapezoidal opening.

9. The bottle opening device retained by a box of claim 7 wherein:

said bottle opening device includes a substantially trapezoidal opening, said leverage edge and said fulcrum edge are formed on opposing sides of said trapezoidal opening, said leverage edge includes a medial tooth.

10. The bottle opening device retained by a box of claim 7 wherein:

said bottle opening device includes a cap slot formed in one side thereof, said slot includes said leverage edge and said fulcrum edge, said leverage edge and said fulcrum edge are formed on opposing sides of said slot.

11. The bottle opening device retained by a box of claim 7 wherein:

perforations encompass said bottle opening device, said perforations are capable of allowing said bottle opening device to be removed from said first and second layers.

12. The bottle opening device retained by a box of claim 7 wherein:

an alpha-numeric code is affixed to said bottle opening device.

* * * * *